US006044681A

United States Patent [19]

Frenken

[11] Patent Number: 6,044,681

[45] Date of Patent: Apr. 4, 2000

[54] PRESSING TOOL

[75] Inventor: Egbert Frenken, Wermelskirchen, Germany

[73] Assignee: Gustav Klauke GmbH, Germany

[21] Appl. No.: 09/180,573

[22] PCT Filed: Mar. 17, 1998

[86] PCT No.: PCT/EP98/01392

§ 371 Date: Dec. 4, 1998

§ 102(e) Date: Dec. 4, 1998

[87] PCT Pub. No.: WO98/40178

PCT Pub. Date: Sep. 17, 1998

[30] Foreign Application Priority Data

| | | | |
|---|---|---|---|
| Mar. 11, 1997 | [DE] | Germany | 197 09 993 |
| Sep. 10, 1997 | [DE] | Germany | 197 39 646 |
| Jan. 30, 1998 | [DE] | Germany | 198 03 536 |

[51] Int. Cl.[7] ..... B21D 39/04

[52] U.S. Cl. ..... 72/292; 72/402; 29/237

[58] Field of Search ..... 72/292, 402, 453.15; 29/237

[56] References Cited

U.S. PATENT DOCUMENTS

| | | | |
|---|---|---|---|
| 2,800,867 | 7/1957 | Smith | 72/292 |
| 2,871,812 | 2/1959 | Pederson | 72/292 |
| 2,973,024 | 2/1961 | Merriman | 72/402 |
| 3,555,875 | 1/1971 | Clark | 72/292 |
| 5,598,732 | 2/1997 | Dischler | 72/292 |

FOREIGN PATENT DOCUMENTS

| | | | |
|---|---|---|---|
| 0451806A1 | 10/1991 | European Pat. Off. . | |
| 2270029A | 12/1975 | France | 72/402 |
| 4240427 | 1/1994 | Germany | 72/292 |
| 19537825 | 12/1996 | Germany | 72/292 |
| 29721759 | 4/1998 | Germany | 72/292 |
| 480411 | 2/1938 | United Kingdom | 72/402 |

*Primary Examiner*—Daniel C. Crane
*Attorney, Agent, or Firm*—Trexler, Bushnell, Giangiorgi & Blackstone, Ltd.

[57] ABSTRACT

The invention relates to a pressing tool (1) for compressing pipe ends. In order to improve such a tool, a bearing (8) and an abutment (13) are configured on the tool (1).

15 Claims, 8 Drawing Sheets

Figure 1:
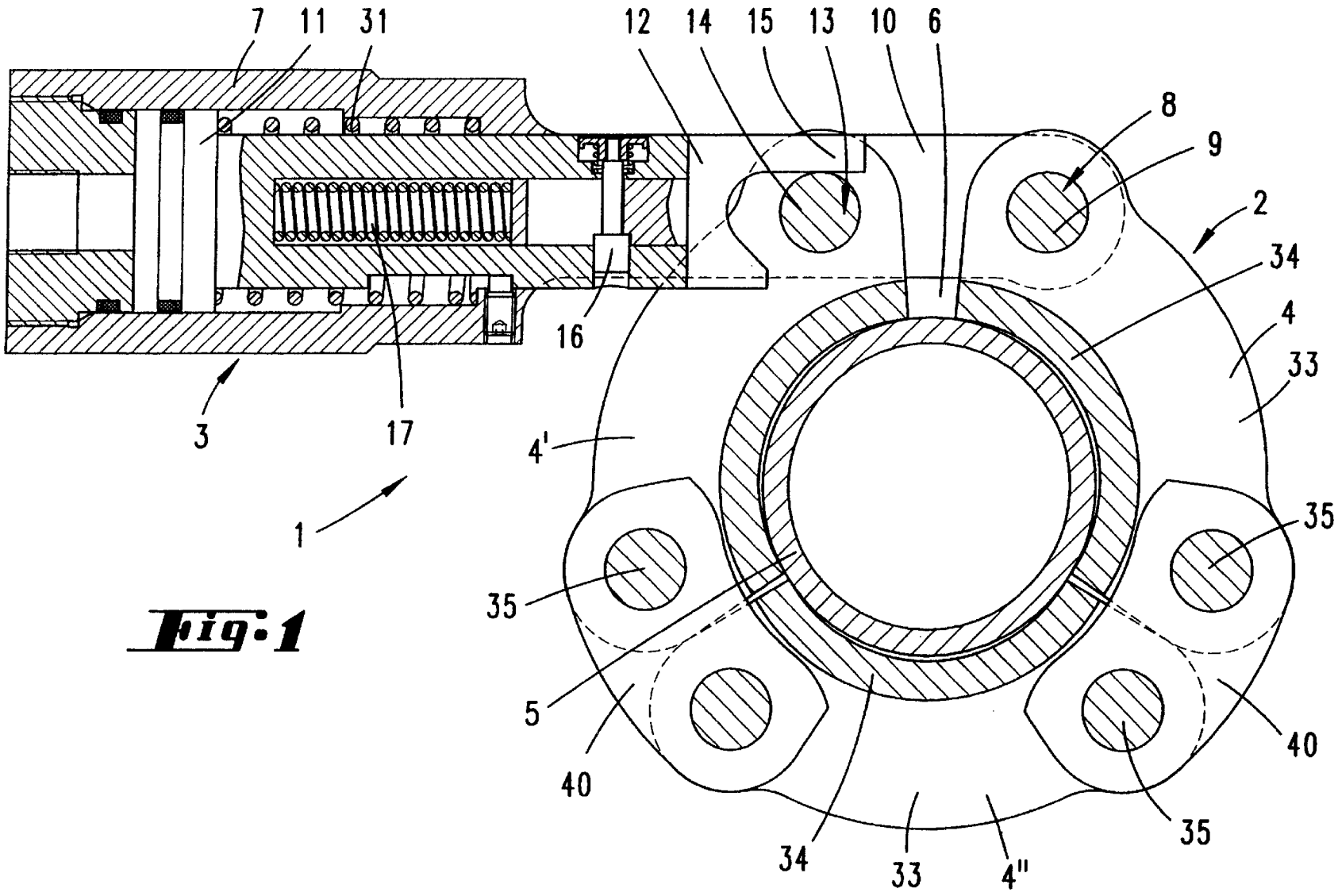

Fig. 4
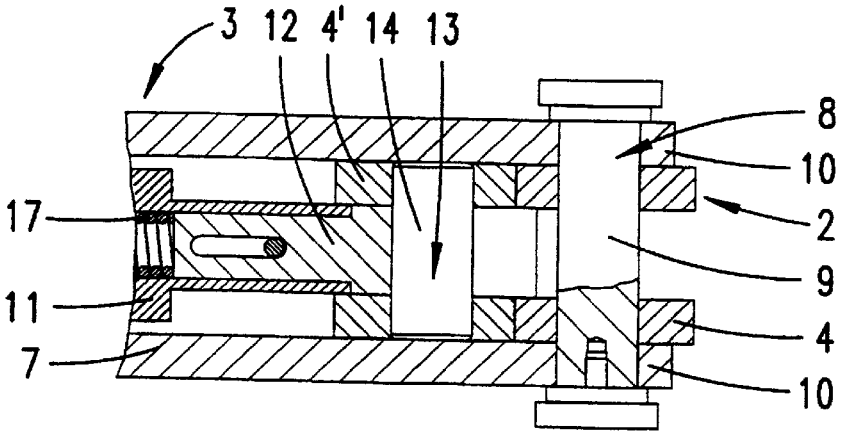
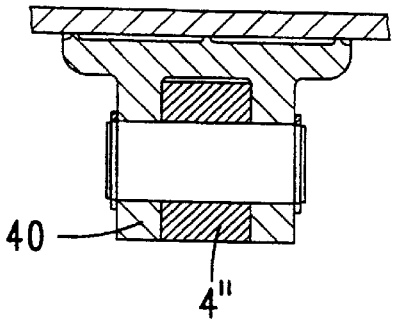
Fig. 5
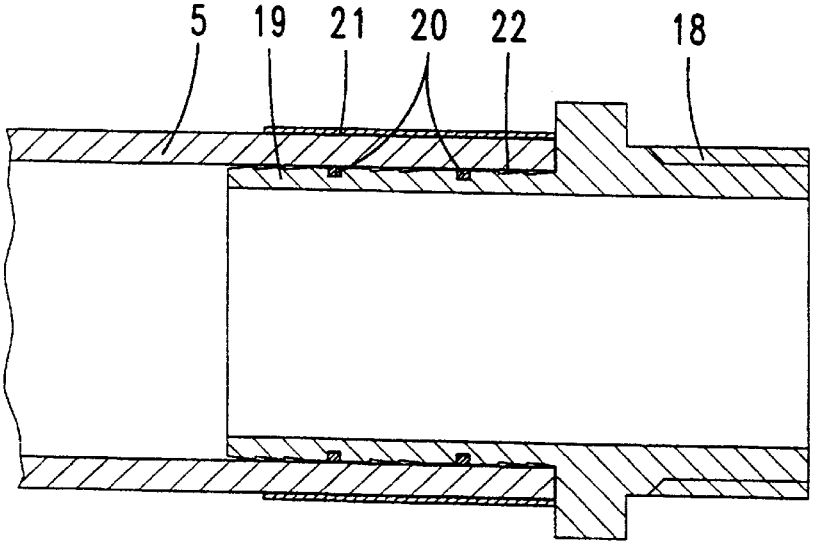
Fig. 6

28
28
29
23
30
25
24
3
1
26
27
14
6
13
9
8
4'
4
2
5
34
33
33
35
40
40
35
35
34
4"

23
13
24
9
8
39
34
38
4
33
37
5
35
36
36
40
35
37
2
34
33
36
4'
37
34
38
37
35
40
14
38
33
4"
36
35

PRESSING TOOL

This application is a 371 of PCT/EP98/01392, filed Mar. 17, 1998.

This invention concerns a pressing tool for compressing pipe ends.

Systems in which the pipe ends are provided with press fittings are increasingly being used for hot water and tap water installations. These eliminate the need for screwing, welding and soldering, which can lead to undesirable structural changes in metal pipes. Moreover, it is also possible to process plastic pipes or metal/plastic compound tubes with this technique. The compression can also be carried out in a short time. For joining metal pipes of copper or high-grade steel, the fitting has a tubular end, for example, into which the connecting pipe is inserted. This area of the fitting is then shaped into a hexagon, e.g., by externally applied forces. This yields a form-fitting connection of the fitting and the pipe by means of which the forces arising from internal pressure are transmitted. A tight connection is guaranteed by a gasket installed in the fitting. Most of the pressed pipe diameter is less than about 40 mm. In this range, it is customary to perform compression by means of tong-like tools, where two cheek plates, each with a semicircular recess, corresponding to the pressing geometry, are moved toward one another like scissors. This principle is not feasible for larger pipe diameters, e.g., with a nominal diameter of more than 63, because the pressing forces and hence the tongs become very large, and the unfavorable shearing movement in this case leads to uneven compression.

With regard to the state of the art described previously, the technical object of this invention is to improve the pressing tool of the type in question.

This problem is solved and the object is achieved by the invention, which is based on a bearing and an abutment being provided on the pressing tool. Furthermore, according to this invention, an extruding die is also provided according to this invention, having at least two press elements. An advantageous embodiment provides that for compression, the extruding die is acted upon by a holding fixture. The chucking fixture may have a hydraulic cylinder, for example, for this purpose. An advantageous embodiment of the object of this invention proposes that the chucking fixture has a prestressed spring. In addition, according to this invention an end piece of the chucking fixture acting against the abutment is catch-locked in an open position. It is also advantageous for the end piece to be catch-locked in a prestressed position. Another provision according to this invention is that the chucking fixture acts on the extruding die by means of tong-like jaws. According to another embodiment, the open position of the extruding die is limited by stops on the press elements relative to one another or the press elements on the straps. Due to this embodiment, the extruding die in the open position is held in a prior use position. Due to the stop limiting of the individual press elements relative to one another or the press elements on the straps, the swiveling motion of the extruding die is limited. The individual press elements thus do not exhibit the freedom in swiveling known to be associated with conventional chains. Thus, the pressing tool, with the open extruding die can be guided well to the workpiece to be compressed. A preferred design here is one where the press elements of the extruding die in an open position are aligned approximately axially to the chucking fixture or with a slight curvature according to a large opening radius. It has also proven advantageous for a press element to have an internal collar section. As a rule, extruding dies act on a thin-walled bushing which is pushed onto the pipe ends. When there is a great reduction in diameter of these bushings, under some circumstances a fold may develop between the press elements moving toward one another. This disadvantageous effect is counteracted by this invention by the fact that the ends of the collar sections of two press elements in the circumferential direction are profiled such that they overlap in the compressed state. It is significant here that the dividing line between the individual press elements does not have a straight axial contour, but instead runs tangential to the press elements and thus also runs at an offset tangentially to the compressing bushing or press fittings. Ends of the collar sections of two press elements in the circumferential direction can thus engage with one another like gear teeth in the course of the compression, which thus counteracts the development of a fold between the press elements advancing toward one another. In a preferred embodiment, however, one end of a collar section has a wedge-shaped fitting projection, and the respective other end of the collar section has a wedge-shaped notch, so that the dividing line between the press elements is offset in a triangular pattern in the tangential direction. In another embodiment of this invention, the ends of the collar section adjoin without mutual overlapping in the area of the back of the cheek plate. To prevent development of a fold, only the press surface area of the press elements is relevant, so the dividing line between the press elements in the area of the backs of their cheek plates may have a flat axial contour. The separation of the dividing lines according to this invention may be provided between all press elements. Under some circumstances, however, it is also sufficient to unmold them only at closing point of the extruding die, since the movement during the closing is at greatest in the circumferential direction of the pipe. In terms of the manufacturing technology, the separation described in this invention can be achieved in an extremely simple manner with an extruding die as a turned part by dividing by means of wire cutting (spark erosion). In another preferred embodiment, the collar section is designed essentially as a cup-shaped section extending perpendicular to the back of the cheek plate. The force is transmitted to the part to be compressed by way of these cup-shaped sections of the individual press elements in the course of the clamping. In another embodiment the stop is formed between an outer curved surface of the cup-shaped section and a stop section of the strap. As a result, each cup-shaped section of the extruding die in the open position is supported on the respective stop sections of the straps connecting the press elements. In addition, the design may also be selected so that the stop section is designed like a corner on the strap. As an alternative, the individual press elements may be supported against one another in the open position in the area of their respective ends. In order to not only guarantee mutual support of the press elements, but also limit the movement of the resulting strand, which is rigid in the opening direction, with respect to the pressing tool in the open position, it is proposed that a stop be provided on the bearing next to the connecting bolt. Due to the embodiment of the pressing tool according to this invention, it is suitable for all diameters. Compression of large pipes is especially improved. Furthermore, advantageous properties are achieved. Consequently, this yields a more uniform compression, due to the fact that the extruding die is advantageously is divided into more than two parts, so there is not much pinching of the bushing material at the impact points, for example. Inducing a pressing force in the tangential direction reduces the magnitude of the force by a factor of approximately pi in comparison with radial application of compression force. The pressing path is likewise increased by the same factor. Finally, it is conceivable for the extrusion die to be arranged on the pressing tool by means of two detachable bearings, with both bearings being designed as hooks, for example.

Figure 2:
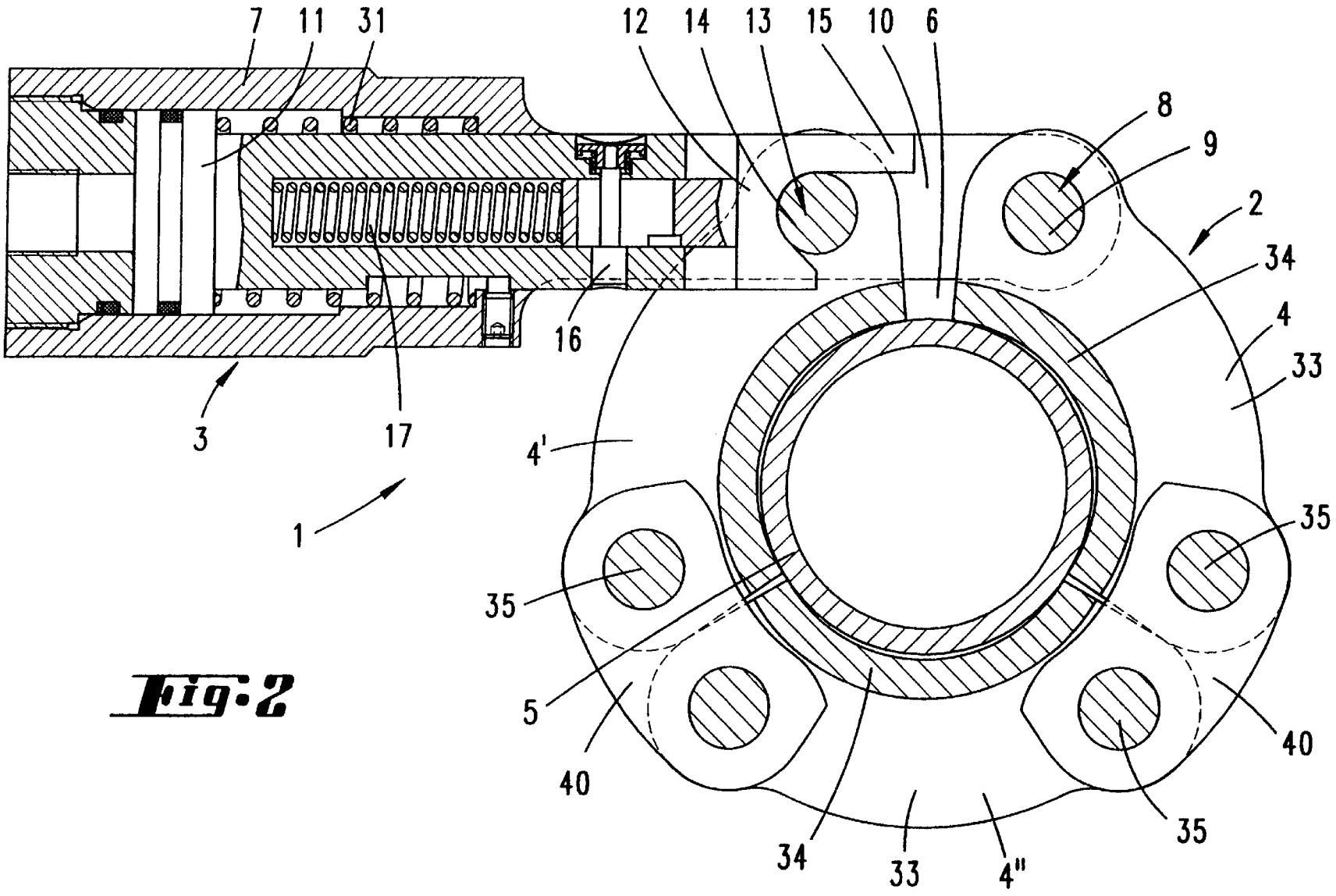
Figure 3:
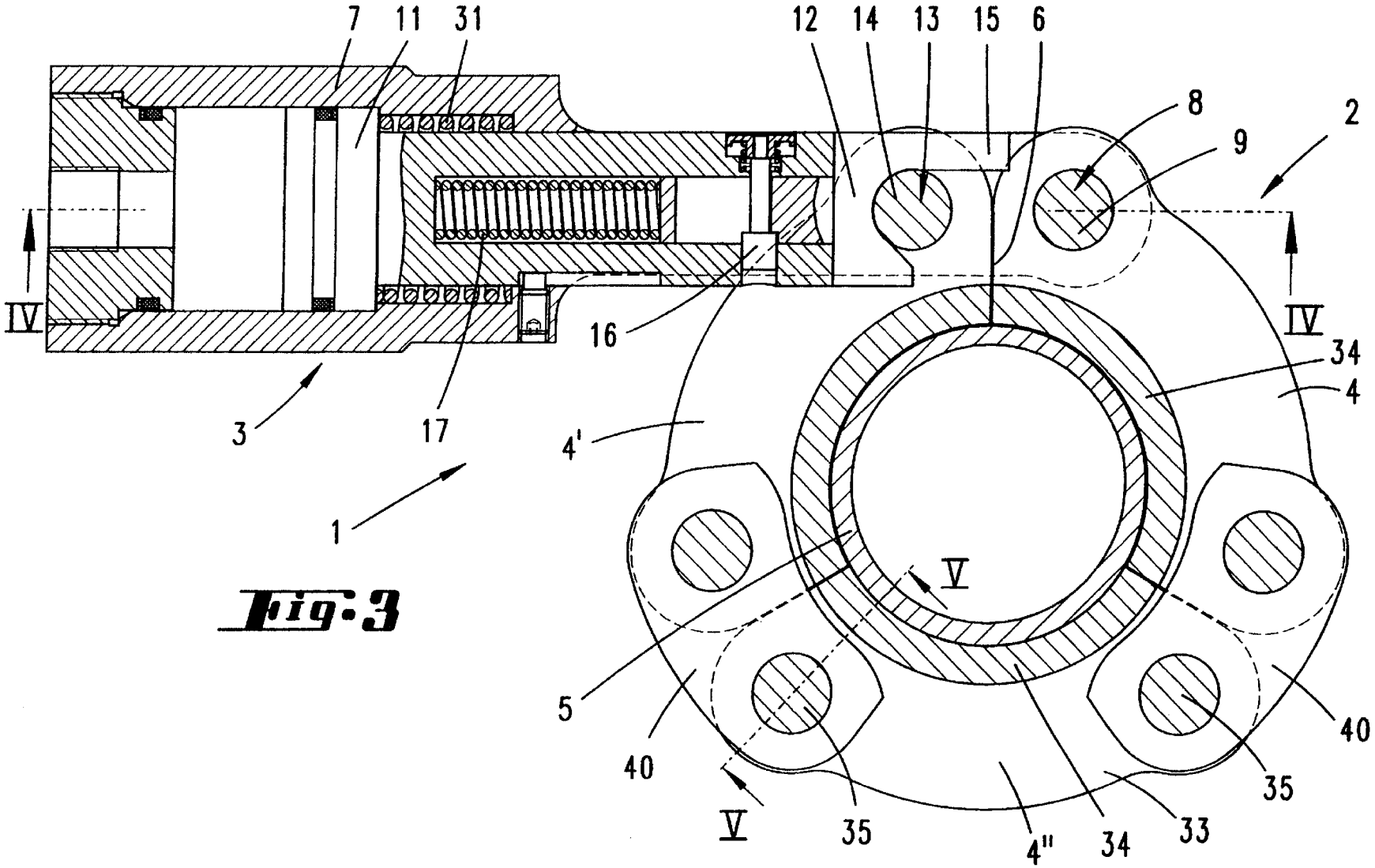
Figure 7:
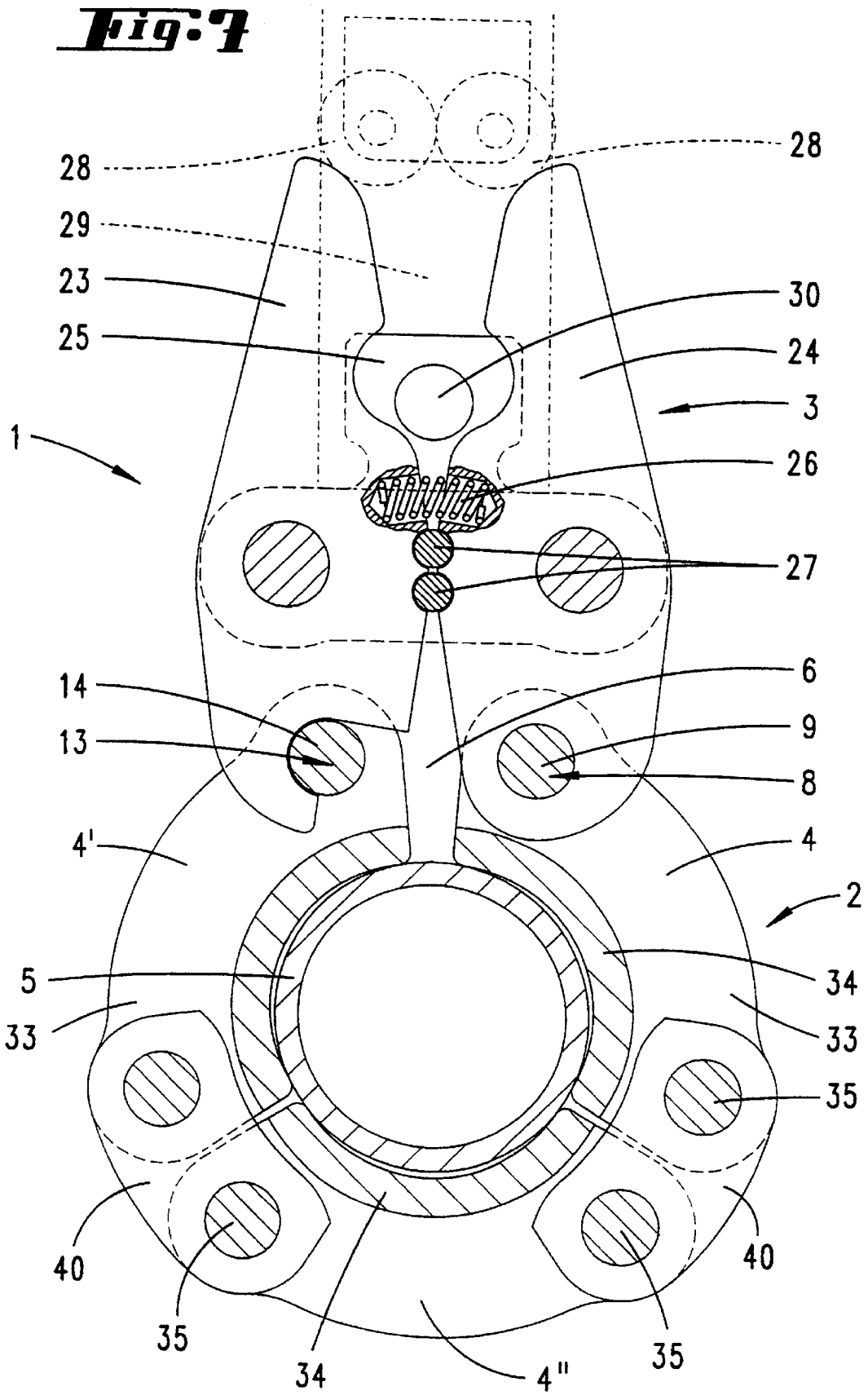
Figure 8:
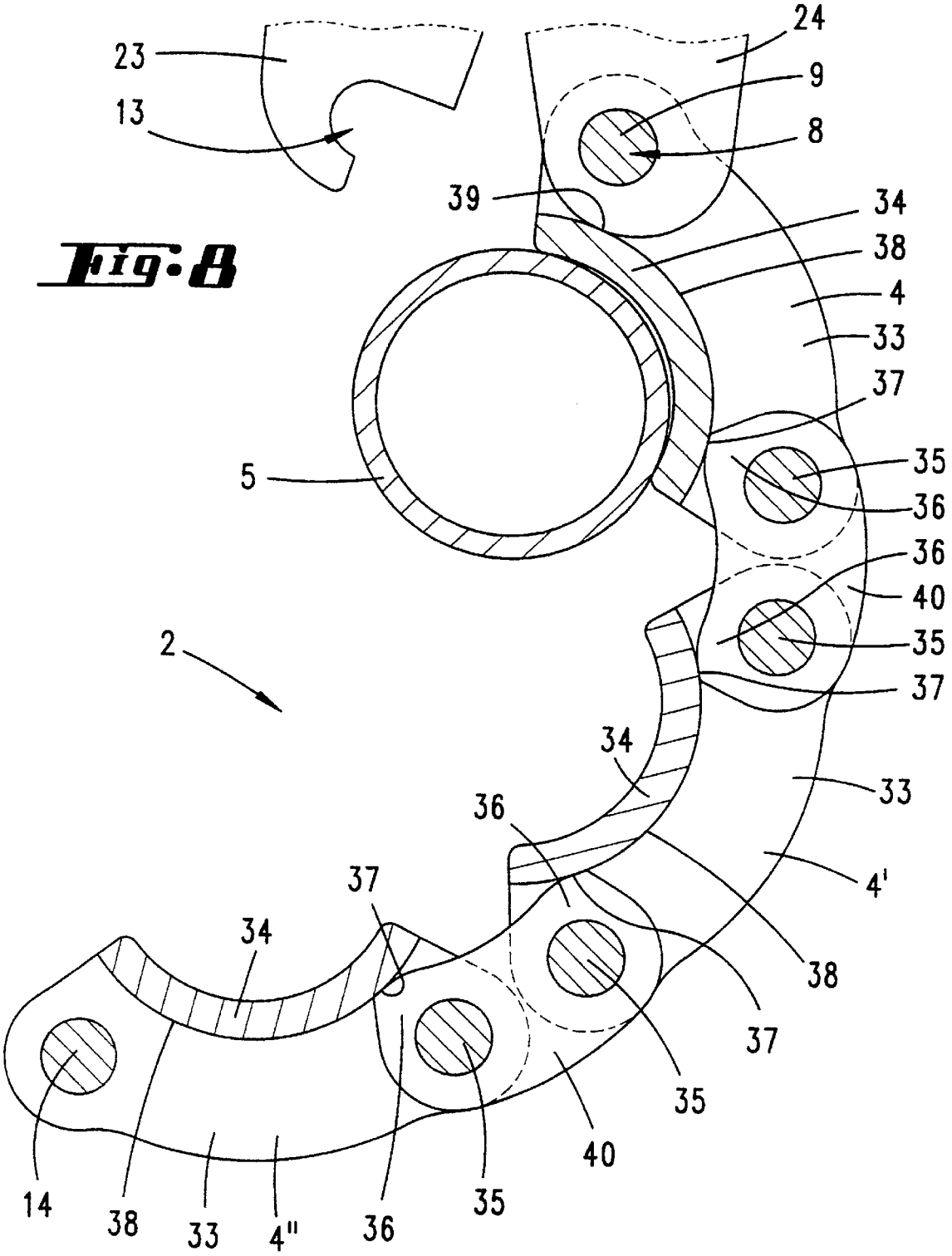
Figure 9:
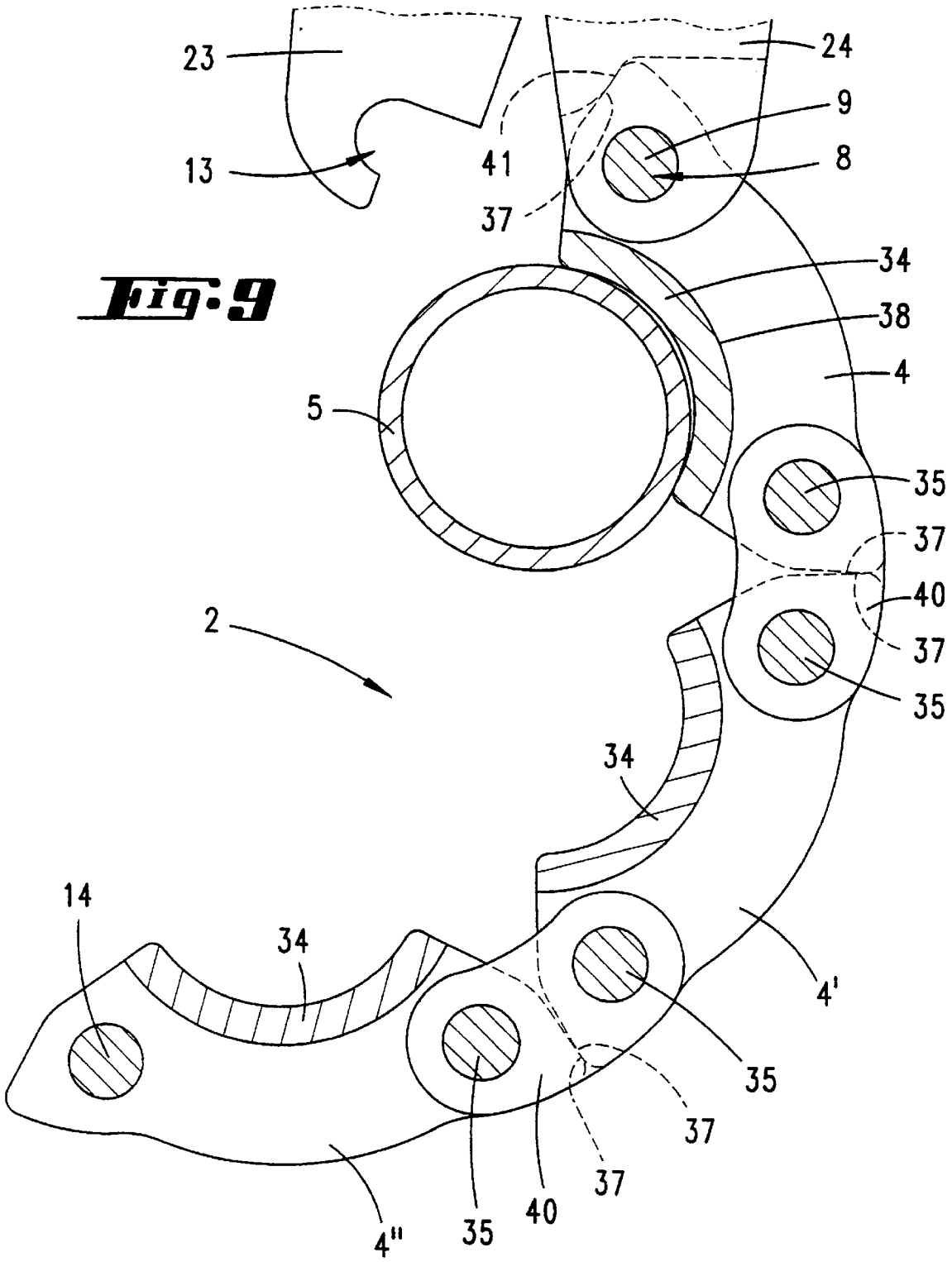
Figure 10:
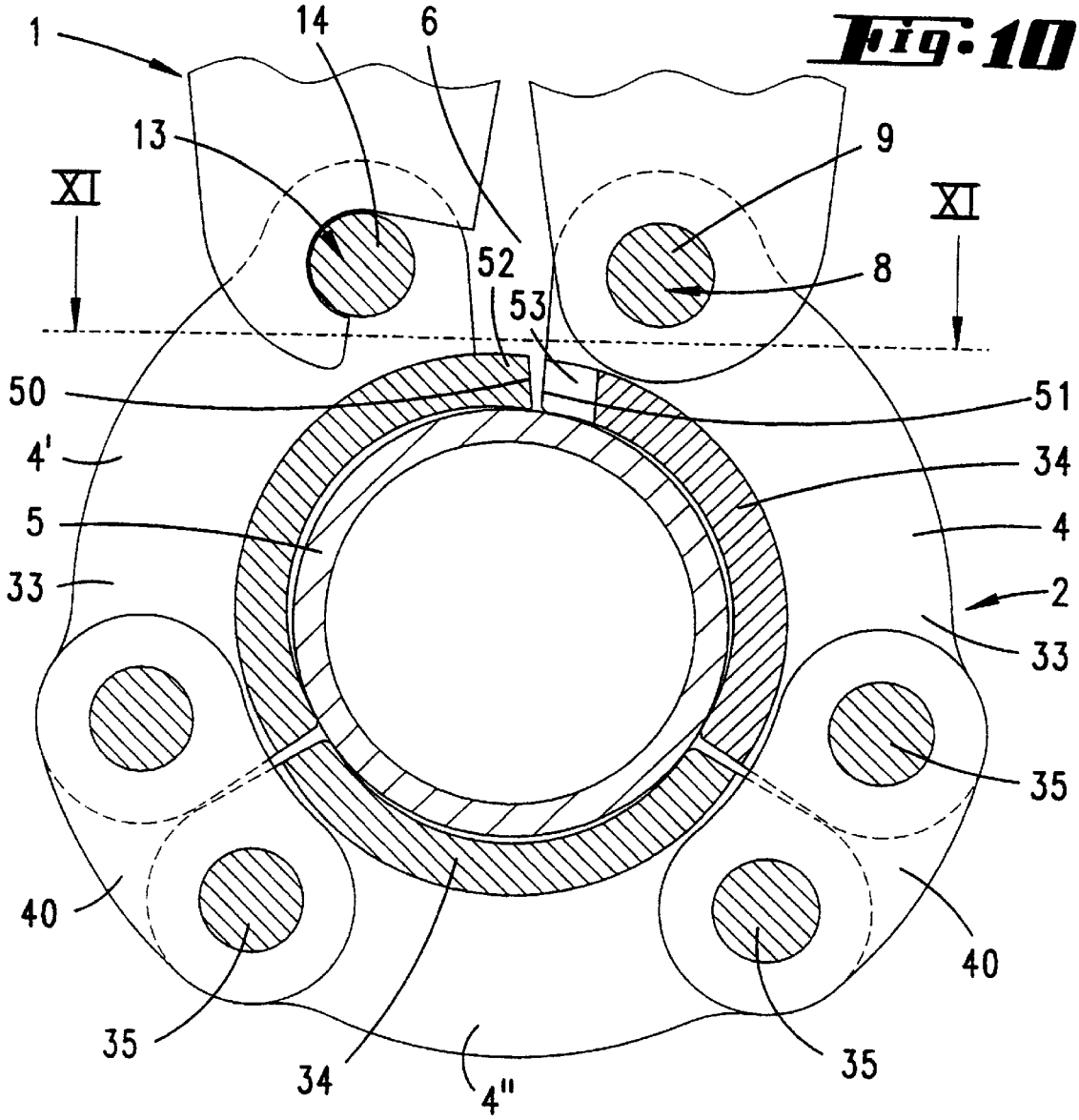

This invention is described in greater detail below on the basis of the accompanying drawings, which represent only a few possible embodiments. They show:

FIG. 1: a pressing tool according to this invention with an extruding die, partially cut away, based on the open position;

FIG. 2: a diagram corresponding to FIG. 1, concerning a prestressed position;

FIG. 3: an additional diagram corresponding to FIG. 1, concerning the chucking position;

FIG. 4: a section according to line IV—IV in FIG. 3;

FIG. 5: a section according to line V—V in FIG. 3;

FIG. 6: a section through a tie line between a pipe end and a pressed fitting;

FIG. 7: an alternative diagram of the pressing tool in a partially cut away view;

FIG. 8: the pressing tool in a stop-limited open position of the extrusion die, based on a first embodiment of the stop;

FIG. 9: a diagram corresponding to FIG. 8, showing another embodiment;

FIG. 10: another alternative embodiment of the pressing tool; and

Figure 11:
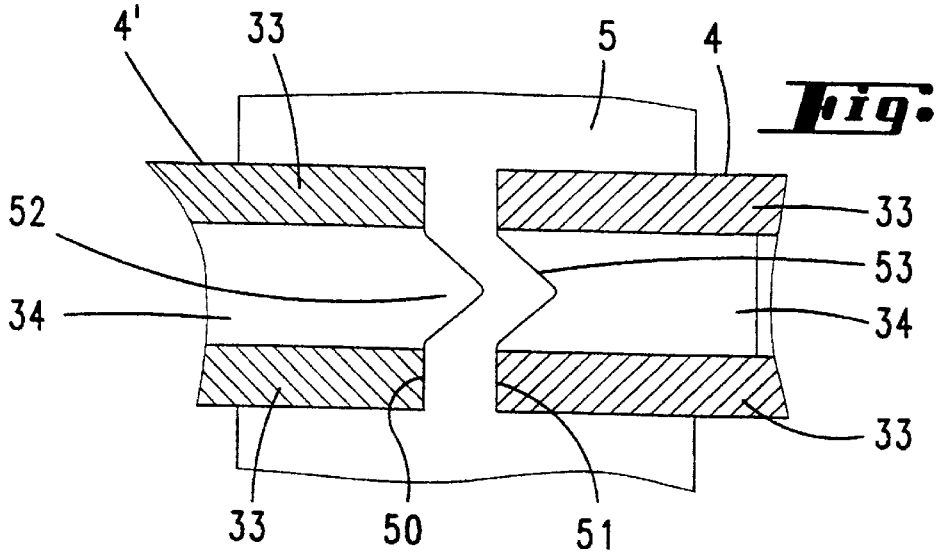

FIG. 11: a section according to line XI—XI in FIG. 10.

A pressing tool 1 is first presented and described with reference to FIG. 1; it is composed essentially of an extruding die 2 and a chucking fixture 3. Extruding die 2 consists of a plurality of press elements 4, preferably the same, which are joined together in a hinged manner or in the manner of a chain by means of straps 40. In the embodiment shown here, three press elements 4, 4', and 4" which are linked together like a chain are provided.

On the inside surface, the individual press elements 4 through 4" are provided with a press geometry which leads to the desired compression of pipe 5 to be compressed when the chain is closed. For this purpose, each press element has an internal collar section which is designed as a cup-shaped section 34, extending essentially perpendicular to a back of the cheek plate 33.

To perform a compression, the extruding die 2 which is designed as a chain is placed around the pipe 5. In the area of the slot 6 left between press elements 4 and 4', the chucking fixture is arranged on the extruding die 2, and this chucking fixture 3 closes the extruding die 2 in the tangential direction.

The chucking fixture 3 has a hydraulic cylinder 7 which encompasses the press element 4 like a fork and is connected to it by a bolt 9 which forms a bearing 8 (see FIG. 4). The fork arms acting on bearing 8 are labeled with reference number 10.

The bolt 9 forming the bearing 8 is released only when another pipe size is to be processed, i.e., while pipe 5 is encompassed, the extruding die 2 remains connected to hydraulic cylinder 7.

A spring-loaded end piece 12 is guided in the piston 11 of hydraulic cylinder 7 and presses like a fork against a bolt 14 which is fixedly connected to press element 4' and forms an abutment 13.

The mounting of the pressing tool is explained in detail below. FIG. 1 shows the initial state, where hydraulic cylinder 7 has already been swung into position. As shown here, this position is defined by a fork 15, which is elongated on one side, of the end piece 12, which strikes against the bolt 14.

The end piece 12 is in a locked position, where the end piece 12 is held by a stop bolt 16. A prestressed spring 17 is maximally compressed here.

FIG. 2 shows the arrangement after the stop bolt 16, by manual operation, has released the end piece 12, which now presses with the relatively slight force of the prestressed spring 17 against the bolt 14 or the abutment 13. By appropriately selecting the prestressing force, the entire pressing device is now secured on the pipe fitting. Thus, the operator has both hands free and can check for proper seating of the pressing tool 1 and can apply pressure to the hydraulic cylinder without risk. First the prestressed spring 17 is again compressed until the piston 11 strikes the end piece 12. The stop bolt 16 is shifted back into its initial position, so the end piece 12 is engaged again.

With a further increase in pressure, the force necessary for compressing is created and acts on bolt 14 and on abutment 13 via the contact faces of piston 11 and end piece 12—without the prestressed spring 17 previously connected in series—and closes the extruding die 2. At the end of this process, the condition according to FIG. 3 is reached. After releasing the pressure, the piston 11, together with end piece 12 locked in place is moved back into the starting position by means of a restoring spring 31. The cylinder can then be swung away, while the front bolt 9 forming the bearing 8 is not released. Then the chainlike extruding die 2 can be removed.

FIG. 6 shows a conventional design of a compressed pipe fitting for metal composite pipes 5. The latter consist of a thin metal pipe, usually made of aluminum, coated with plastic sheathing on the inside and the outside. For the sake of simplicity, the internal design of composite pipe 5 is not shown In FIG. 6. In compression of such pipes, pipe fittings 18 are generally used, having an inside connection piece 19 with ring gaskets 20, said inside connection piece 19 being pushed onto the pipe 5 to be connected. On the outside a thin steel sleeve 21 is placed over pipe 5. This steel sleeve 21 is then shaped in the form of peripheral grooves, for example, by compressing forces applied externally, thus forming an intimate connection between pipe 5 and the inside connection piece 19 of the fitting. This connection can be further reinforced by sawtooth shaped recesses 22 on the inside connection piece 19.

FIG. 7 shows an alternative embodiment of the pressing tool 1, where the bolts 9 and 14, which form the bearing 8 and abutment 13, are closed by tong-like jaws 23, 24. These jaws 23, 24 correspond to the cheek plates used for smaller nominal widths, i.e., they can be operated with existing tools.

The closing tool according to FIG. 7 consists essentially of tong legs 23, 24, which are connected to straps 25. In the front area, tong legs 23, 24, are connected to bolts 9 and 14, where bolt 9 here is also completely surrounded by tong leg 24. Tong leg 23 is open in a semicircle to receive bolt 14, so that assembly simply by hooking it in is possible.

A compression spring 26 holds tong legs 23, 24 under a slight prestress, so that extruding die 2 as well as the closing tool automatically seize on pipe 5.

Furthermore, two parallel pins 27 are provided between tong legs 23 and 24, guaranteeing an approximately symmetrical closing movement of tong legs 23, 24.

The closing movement is accomplished by a drive motor, but only the guide rollers 28 and the cheek plate mount 29 are shown here. The drive motor moves the guide rollers 28 inward against the curved paths of tong legs 23, 24. The bolt 30 connects the closing tool with the drive motor, by inserting it into the drive motor by strap 25 and cheek plate mount 29.

It is also conceivable for the extruding die to be mounted on the pipe with the help of a simple clamp belonging with it and then to mount the drive motor, e.g., a hydraulic cylinder or tong closing tool. This procedure may be advantageous with very large pipe diameters, since the weight of the extruding die is considerable with such pipes.

FIGS. 8 and 9 show two alternative embodiments of the extruding die 2. Both show a stop limit for the individual press elements 4, 4' and 4".

Thus in the embodiment according to FIG. 8, each strap 40 has a stop section 37 in the are of eyes 36 through which pass hinge pins 35 for connecting a press element. The stop section faces essentially in the direction on the outer curved surface 38 of one of these respective cup-shaped sections 34 of an extruding die 4, 4' or 4". The respective stop section 37 of the strap 40 is designed with corners.

In the open position of the extruding die 2 according to FIG. 8, the cup-shaped sections 34 of the cheek plates 4, 4', 4" are supported on the respective stop sections 37 of the strap 40, so that the extruding die 2 behaves like a stiffened bend in this position in the opening direction. The opened extruding die remains here in a slightly curved position corresponding to a large opening radius.

To guarantee stop limiting for the entire extruding die 2 with respect to pressing tool 1, a stop 39 is also provided in the area of the bearing 8. The latter is formed on the end face of the pressing tool cheek plate 24 facing the outer curved surface 38 of the cup-shaped section 34 of press element 4. This end face forms a curve eccentric to the bearing 8. In the open position of extruding die 2, this end face is opposite the cup-shaped section 34 of press element 4, so the outer curved surface 38 of this press element 4 strikes the stop 39.

The entire extruding die 2 is thus entirely stop-limited in its opening movement, which offers handling advantages in particular. Thus pressing tool 1 with extruding die 2 open can easily be brought to pipe 5 or a similar object without extruding die 2 tilting downward in the manner of an ordinary chain. The stop limiting according to this invention yields a ridge-like prior use position.

Stop 39 designed to support the entire extruding die 2 may also be provided in the area of a fork arm 10 of pressing tool 1 in the first embodiment according to FIGS. 1 through 3.

FIG. 9 shows an alternative embodiment of the stop limit. Press elements 4, 4', 4" are supported directly upon one another here, i.e., they are not supported by straps 40 which connect them.

Stop sections 37 here are designed in the area of the facing ends of each press element 4, 4', 4" are designed so that they are supported with respect to one another in the area of overlap with strap 40 in the open position of extruding die 2 according to FIG. 9. Extruding die 2 with its spine-like design in the open position is also stop-limited in its motion like the pressing tool. Therefore, a stop shoulder 41 which works together with the free stop section 37 of press element 4 is provided in the area of the pressing tool jaw 24 near the bearing 8. The extruding die 2 is held in a slightly curved position when open by means of said stop shoulder.

Regardless of the embodiment selected for the stop limit, press elements 4, 4', 4" as well as the straps connecting them are designed essentially identically and symmetrically in the respective embodiment.

FIGS. 10 and 11 show another embodiment of the extruding die 2 according to this invention, where the ends 50, 51 of the press elements 4 and 4' provided in the circumferential direction are designed with a profiled contour. Specifically, the design is selected such that each cup-shaped section 34 of press elements 4, 4' forming the pressing surfaces have a profiled contour on their facing sides in the axial direction of the press elements, such that the end 50 of the cup-shaped section of press element 4 has a wedge shaped projection 52, which is essentially in the center in the axial direction, and which can be paired with a corresponding wedge-shaped cutout 53 in the opposite end 51 of the cup-shaped section of press element 4.

The end 50 of press element 4' thus forms a positive mold, while end 51 of press element 4 forms a corresponding negative mold.

The ends 50 and 51 of the cup-shaped section are not designed to overlap in the area of the backs of the cheek plates 33 with respect to a dividing line between the two press elements 4 and 4', so that in the course of a compression, these backs of the cheek plates 33 abut bluntly.

FIG. 11 shows the design according to this invention of the two cup-shaped section ends 50, 51. In this embodiment, the dividing line between the two press elements 4 and 4' is offset in a triangular form from its axial direction to a tangential direction to the pipe to be compressed. This counteracts the development of a fold in the dividing line during compression of a pipe, particularly with a great reduction in diameter. In the compression state, ends 50 and 51 of press elements 4 and 4' overlap to form a dividing line running in labyrinthine pattern in the axial direction.

In the embodiment shown here, only profiling of the ends of the press elements provided for the closing point of the extruding die 2 are shown. It is conceivable, however, for all the ends of the cup-shaped sections 34 provided in the circumferential direction to be provided with a similar profiling, e.g., between press element 4' and press element 4", or between the latter and press element 4.

In other types of embodiments (not shown), the connection between the jaw 24 or fork arm 10 and extruding die 2 may be designed to be releasable, e.g., in the form of a hook connection.

All the features disclosed here are essential to this invention. The disclosure content of the respective/attached priority documents (copy of the previous patent application) is herewith included fully in the disclosure of the present patent application, also for the purpose of including features of these documents in claims in the present patent application.

I claim:

1. Pressing tool (1) for compression of pipe ends with a pressing die comprising a plurality of press elements connected to one another by a connecting member, the pressing die is acted upon by a chucking fixture to produce the compression, whereby each press element has an internal collar section for engaging a pipe end, characterized in that the ends of the collar sections of two press elements provided in the circumferential direction are profiled with respect to a pressing surface so that they overlap in the compression state.

2. Pressing tool according to claim 1, characterized by an a pressing die (2) which has at least two press elements (4, 4', 4").

3. Pressing tool according to claim 1 or claim 2, characterized in that the chucking fixture (3) has a hydraulic cylinder (7).

4. Pressing tool according to claim 1, characterized in that an end piece of the chucking fixture (3) acting against the abutment (13) is catch locked in an open position.

5. Pressing tool according to claim 1, characterized in that the end piece (12) is catch locked in a prestressed position.

6. Pressing tool according to claim 1, characterized in that the chucking fixture (3) acts on the pressing die (2) by means of tong-like jaws (23, 24).

7. Pressing tool according to claim 1, characterized in that the open position of the pressing die (2) is limited by stops on the press elements (4, 4', 4") among one another or on the press elements (4, 4', 4") against the connecting member (40).

8. Pressing tool according to claim 1, characterized in that in an open position, the press elements (4, 4', 4") of the pressing die (2) are aligned approximately in the axial direction of the chucking fixture (3) or are slightly curved, corresponding to a large opening radius.

9. Pressing tool according to claim 1, characterized in that one press element (4, 4', 4") has an internal collar section.

10. Pressing tool according to claim 1, characterized in that the end of the collar (50) has a wedge-shaped projection (52) and the other collar end (51) paired with it has a wedge-shaped cutout (53).

11. Pressing tool according to claim 1, characterized in that the collar ends (50, 51) in the area of a back of the cheek plate (33) abut against one another without overlapping.

12. Pressing tool according to claim 7, characterized in that the collar section is formed as a cup-shaped section (34) essentially running perpendicular to the back of the cheek plate (33).

13. Pressing tool according to claim 12, characterized in that the stop is formed between an outer curved surface (38) of the cup-shaped section (34) and a stop section (37) of the connecting member (40).

14. Pressing tool according to claim 7, characterized in that the stop section (37) is designed like a corner on the connecting member (40).

15. Pressing tool according to claim 1, further comprising a stop limiter for stop limiting the pressing die, said stop limiter comprising a stop formed on a bearing (8) adjacent to a connector bolt (3).

* * * * *